United States Patent [19]

Nattrass et al.

[11] Patent Number: 4,807,299

[45] Date of Patent: Feb. 21, 1989

[54] BULK CONTAINERS

[75] Inventors: Frank Nattrass, Harrogate; Geoffrey Page, Leeds, both of England

[73] Assignee: Bowater Packaging Limited, London, England

[21] Appl. No.: 100,114

[22] Filed: Sep. 23, 1987

[30] Foreign Application Priority Data

Sep. 23, 1986 [GB] United Kingdom ..... 8622893

[51] Int. Cl.[4] ..... B65D 30/08

[52] U.S. Cl. ..... 383/109; 383/7; 383/19; 383/20; 383/24

[58] Field of Search ..... 383/7, 8, 17, 19, 20, 383/21, 24, 109, 119, 903

[56] References Cited

U.S. PATENT DOCUMENTS

| | | | |
|---|---|---|---|
| 3,061,170 | 10/1962 | Baker | 383/109 |
| 3,789,897 | 2/1974 | Saito | 383/24 |
| 4,224,970 | 9/1980 | Williamson et al. | 383/17 |
| 4,390,051 | 6/1983 | Cuthbertson | 383/17 X |
| 4,610,028 | 9/1986 | Nattrass | 383/7 |
| 4,646,357 | 2/1987 | Nattrass | 383/20 |
| 4,710,967 | 12/1987 | Petschner | 383/8 |

*Primary Examiner*—Stephen Marcus
*Assistant Examiner*—Nova Stucker
*Attorney, Agent, or Firm*—Henry Sternberg; Bert J. Lewen

[57] ABSTRACT

A flexible bulk container comprises a side wall structure having an outer wall (10) and an inner wall (11) lying within and closely adjacent to the outer wall. A base closes a lower open end of the side wall structure. A plurality of lifting loops are provided at the upper end of the side wall structure, each lifting loop having a first end that is connected to or integral with the outer wall (10) and a second end that is connected to or integral with the inner wall (11).

16 Claims, 2 Drawing Sheets

BULK CONTAINERS

This invention relates to flexible bulk containers such are used in the storage and transport of materials in granular, powder and other particulate forms, and to a method of making such containers.

Such containers are generally in the form of large bags or sacks which are often required to carry loads of up to one tonne or more with considerable safety margin above their rated working load. The containers are commonly made from woven fabric, particularly woven polypropylene or other suitable synthetic material.

There have in the past been many proposals for the manufacture of such containers, and the common features of such containers have been a side wall structure closed at its open lower end by a base, and lifting means at the upper end of the side wall structure capable of being engaged with a fork lift truck, crane or other lifting mechanism. The side wall structure may be made up from panels of woven fabric, may be formed from a single length of woven fabric stitched to form a tube, or may be formed from tubular woven fabric so as to give a seamless side wall structure. Many different base constructions are known, ranging from a simple base sewn into the opening at the lower end of the side wall structure, to bases formed by cutting, folding and/or stitching extensions of the fabric present in the side wall structure. Such bases may be formed to have closeable and openable discharge arrangements. At the top of the container the lifting means may be in the form of bands which form extensions of the side wall structure, or they may be separate lifting loops, for example loops of high strength webbing, which are stitched to the side wall structure, desirably so that there is reinforcement in the area where stitching occurs.

There is a constant need to improve the working load and reliability of flexible bulk containers, and the present invention seeks to provide an improved container.

According to a first aspect of the invention a flexible bulk container comprises a side wall structure having an outer wall and an inner wall lying within and closely adjacent to the outer wall, a base closing a lower open end of the side wall structure, and a plurality of lifting loops at the upper end of the side wall structure, each lifting loop having a first end that is connected to or integral with the outer wall and a second end that is connected to or integral with the inner wall.

The invention thus provides what can be looked upon as being a double-walled container closed by a base structure common to the two walls. Each lifting loop is connected to or integral with the fabric of both walls, so that lifting stresses are transmitted into both walls. Both walls will generally be of woven fabric, and distribution of lifting stress thus occurs over a much greater width of fabric than in previous single-walled container constructions, so leading to containers capable of higher working load and reliability or, alternatively, for a given rated load, allowing weaker fabric to be used for the side wall structure than was the case in previous containers.

Apart from this improved stress distribution, the double-walled construction provides other advantages. Thus, due to the two layers of fabric, the container gives significantly greater protection to the contents, both against intrusion of water or other liquid into the container and against puncture due to abrasion or impact against the fabric. The double-walled construction also improves retention of the contents inside the container, and indeed it may be possible to dispense completely with the usual impervious lining with which flexible bulk containers are provided.

The first and second ends of each lifting loop may be connected to or integral with the respective outer and inner walls in substantially the same circumferential region of the side wall structure. More desirably, however, the first and second ends of each lifting loop are displaced one from the other around the circumference of the container, as overall stress distribution is thereby improved. In a particularly preferred arrangement, four lifting loops are provided, and the circumferential spacing between the two ends of each lifting loop is substantially equal to the circumferential spacing between adjacent lifting loops.

Preferably either or both of the outer and inner walls is formed from woven fabric comprising base fabric and reinforcing bands woven integrally with the base fabric, each reinforcing band extending from the lower to the upper end of the respective wall, and the respective end of each lifting loop is connected to or integral with a respective one of the reinforcing bands. It is preferred that both inner and outer walls are so formed, and each lifting loop will then have its first end connected to or integral with a reinforcing band in the outer wall, and its second end connected to or integral with a reinforcing band in the inner wall.

It is obviously advantageous to have the lifting loops connected to or integral with strengthened sections of the side wall fabric, and the use of integrally woven reinforcing bands is a convenient way of achieving this.

Formation of a woven fabric having integral reinforcing bands can readily be achieved by conventional weaving techniques. The reinforcing bands may be provided, for example, by the cramming of warp threads in the region of the reinforcing band, i.e. by making the number of warps per centimeter in the reinforcing band regions greater than the number of warps per centimeter in the base fabric of the tube. Alternatively, the reinforcing bands may incorporate warp yarns of higher tensile strength than the warp yarns of the base fabric. These higher strength yarns may replace entirely the warp yarns used for the base fabric, or they may be used in addition to those warp yarns so that each reinforcing band will incorporate both base fabric warp yarns and higher strength warp yarns.

In a preferred arrangement the material may be woven fabric having polypropylene warp and weft threads interwoven in any appropriate weaving pattern, usually smooth woven, although twill, basket and rib weaves may also be used. Interwoven with the polypropylene weft threads in the regions of the reinforcing bands are additional warp threads having a higher tensile strength than the base polypropylene warp threads. The reinforcing threads may be made from any suitable natural fibre or from yarn of synthetic or semi-synthetic polymer, such as polyester, polyamide, polyolefin or polyacrylic. The higher strength warp threads may alternatively also be of polypropylene, which may be of a higher count than the base polypropylene threads or may be a thread similar to the base thread which has been treated, e.g. by fibrillation, in order to increase its tensile strength. The suggested materials given in this paragraph do not constitute an exhaustive list, and other materials that can be used will be apparent to those skilled in the art.

The most preferred construction is one in which each lifting loop comprises an integral extension of a reinforcing band of the outer wall and of a reinforcing band of the inner wall. Two such extensions from the respective walls may be joined to form the loop, but more preferably each lifting loop is continuous.

Forming the lifting loops from such integral extensions means that there are no stitched connections whatsoever between the individual lifting loops and the side wall structure of the container. Apart from avoiding the operation of stitching the loops to the side wall structure, this arrangement voids stress concentrations which would occur at such stitching points, and significantly improves the distribution of stress from the lifting loops over the fabric of the inner and outer walls.

Desirably the inner and outer walls and the lifting loops are all formed from a single continuous length of tubular woven fabric folded to form a double-walled tube, with parts of the base fabric being cut from the remainder of the base fabric in the folded region of the tube. Tubular woven fabric is a particularly suitable material from which to form the container according to the invention, as it produces inner and outer walls which are seamless, and so facilitates manufacture of the container. Furthermore, the use of tubular woven fabric, which has continuous weft threads extending around the full circumference of the respective wall, leads to an additional improvement in stress distribution around the side wall structure.

Those parts of the base fabric which are cut in order to leave the lifting loops of reinforced material may be cut away completely, but more preferably they are folded around the reinforcing band material in order to form the lifting loops. The folded sections give desirable abrasion resistance to the reinforcing band material that is embodied in the loop.

In the preferred form of the container the tubular woven fabric has four reinforcing bands therein, equally spaced around the fabric, the container has four lifting loops, and the inner wall is rotated through 45° relative to the outer wall. The formation of such a container by folding a length of tubular woven fabric to form a double-thickness wall structure and then rotating the inner wall through 45° relative to the outer wall will cause each of the lifting loops to have a 180° twist imparted thereto. This twist is found materially to improve even further the stress distribution in the side wall structure, and the introduction of the twist also renders the loop substantially fully resistant to damage and tear-out from the container, even when the container with its rated load is lifted or pulled with only a single loop engaged by the lifting or pulling means. This provides a simple and inexpensive solution to the problem that is known as "pullout", i.e. the failure of a loop when an attempt is made to lift or pull the container by one loop only.

The container of the invention may have an open top or may be closed by a top stitched around the upper part of the side wall structure. The top may be formed with any suitable opening and/or skirt arrangement. There are many different ways in which the bottom of the container may be formed, and it may, if required, incorporate a suitable discharge arrangement.

From another aspect of the invention, a method of making a flexible bulk container comprises the steps of taking a continuous length of tubular woven fabric that comprises base fabric and reinforcing bands woven integrally with the base fabric and extending parallel to the axis of the tube, drawing one end of the length of fabric into and through the remainder of the fabric to form a double-walled tube, cutting away parts of the base fabric at an upper end of the tube to leave lengths of reinforcing band material upstanding above the remainder of the tube to join together the inner and outer walls of the tube, whereby the upstanding lengths of reinforcing band material form lifting loops at the upper end of a side wall structure formed by the remainder of the double-walled tube, and closing the lower end of the double-walled tube with a base structure.

In order that the invention may be better understood, the manufacture of a specific embodiment of a container will now be described in more detail, by way of example only, with reference to the accompanying drawings in which.

Figure 1:
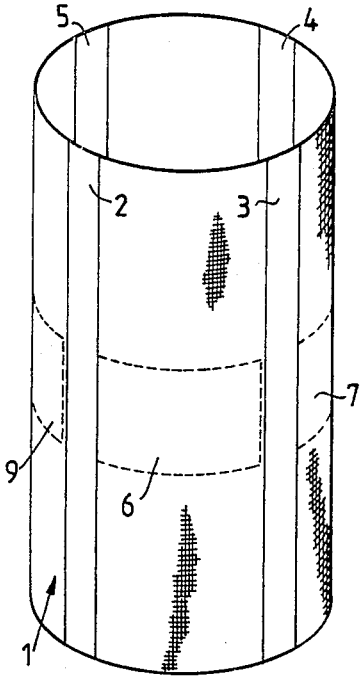
FIGS. 1 to 4 show successive stages in the manufacture of a container.
Figure 2:
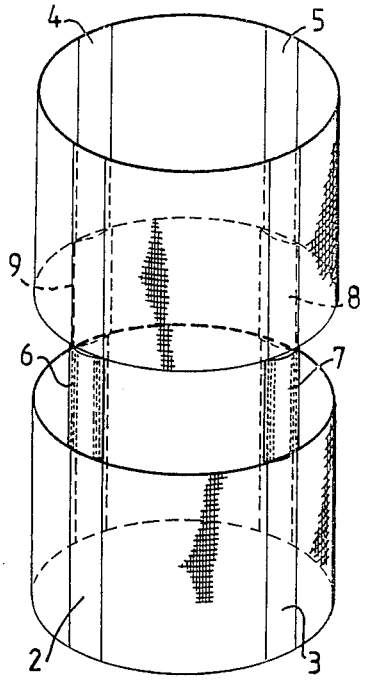
Figure 5:
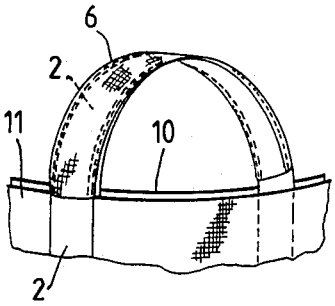
FIG. 5 shows an enlarged detail of part of the container.

Referring now to FIG. 1 this shows a blank in the form of a length of tubular woven fabric. The fabric comprises a base fabric 1 and four parallel reinforcing bands 2 to 5 woven integrally with the base fabric and extending parallel to the axis of the tube. In order to form lifting loops for the container, sections of base fabric lying between adjacent reinforcing bands in the central region of the length of fabric are cut as shown by the dotted lines in order to form four flaps 6 to 9, each attached to one of the reinforcing bands. The flap 6 is then wrapped around the reinforcing band 2 and stitched to each side of the reinforcing band as shown in FIG. 5. Similarly, the flaps 7, 8 and 9 are wrapped around the reinforcing bands 3, 4 and 5 and stitched to each side of the band. The blank then takes the form shown in FIG. 2 of the drawings.

Figure 6:
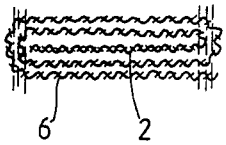
FIG. 6 is an enlarged cross-section through part of the container.

The next step is to take hold of one end of the length of tubular fabric and to turn this inside out and draw it into and through the remainder of the fabric to form a double-walled tube, so effectively folding the fabric around the centre parts of the reinforced sections that will form the lifting loops. The tube then constitutes a side wall structure having an inner wall 10 and an outer wall 11. Either during the folding operation or after that operation the inner wall is rotated through 45° relative to the outer wall to arrive at the structure shown in FIG. 3. It will be seen that this action displaces the first and second ends of each lifting loop from one another by 45° around the circumference of the container, and that the circumferential spacing between adjacent lifting loops is also 45°. The rotation imparts a 180° twist to each loop as more clearly shown in FIG. 6.

Figure 3:
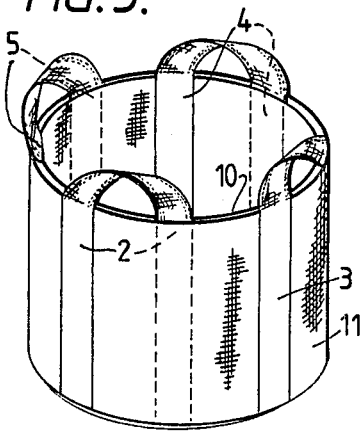
Figure 4:
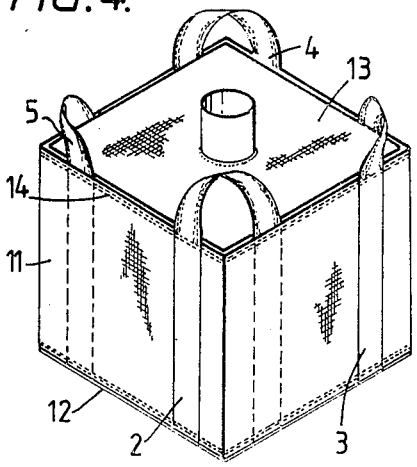

Having achieved the structure shown in FIG. 3, the container may then be finished by adding to it a suitable base structure and a suitable top structure. In its simplest form, as shown in FIG. 4, the base 12 takes the form of a separate cut piece of fabric simply stitched to the lower ends of the two walls in order to close the base of the container. If required, the base may be formed with any suitable spout or other discharge arrangement, desirably before securing the base to the side wall structure. In other arrangements the base may be formed by extensions of the fabric of either the inner wall, the outer wall or both walls, the extensions being suitably cut, folded and stitched to form a base of the required shape. The base shown in FIG. 4 is square, and this effectively dictates a substantially square cross-section for the side wall structure, the base being oriented so that each lifting loop extends across one of the four top corners of the container. However, it is not necessary to use a square base and a circular base or base of any other suitable shape may equally well be used.

It will be noted that the inner wall fits loosely within the outer wall, and is not secured thereto other than by way of the lifting loops and the base. This is desirable as it allows relative movement between the walls in order to enable stress equalisation to occur. Alternatively, however, it would be possible to effect additional securing between the inner and outer walls, for example by stitching the walls together in appropriate regions, e.g. around the top of the container.

FIG. 4 also shows a square top 13 that is stitched around the top of the side wall structure, for example by stitching 14, either to the inner wall only or to both inner and outer walls if these are to be joined in the region of the top of the container. The top may be formed with any suitable filling arrangement. If required, the container may be fitted with an impervious liner, located either within the inner wall, or as an intermediate layer between the inner and outer walls.

The strength that is given to the container by the double-walled structure will be immediately apparent, and it will also be seen that the container can be manufactured quite simply. The strength of the base fabric and of the reinforcing bands forming the lifting loops are, of course, chosen according to the rated load of the container in order to give an appropriate factor of safety, usually required to be at least 5:1. Stress distribution in the side wall structure is found to be excellent, with stress being transferred to both inner and outer walls, those walls being capable of relative movement to achieve optimum stress equalisation. The presence of the 180° twist in each lifting loop also renders the container capable of being pulled or lifted with only a single loop engaged by the handling means.

Figure 7:
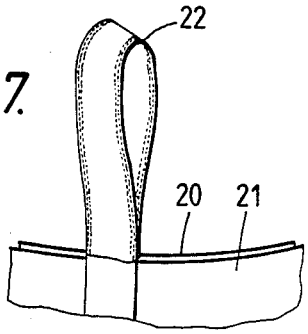
FIGS. 7 and 8 are fragmentary views of other embodiments of container.

In a modified arrangement, as partially illustrated in FIG. 7, the inner wall 20 is not rotated relative to outer wall 21 so that each lifting loop 22 has both ends integral with the inner and outer walls in the same circumferential region of the container. Obviously, rotation through an angle of other than 45° can be effected if required.

Figure 8:
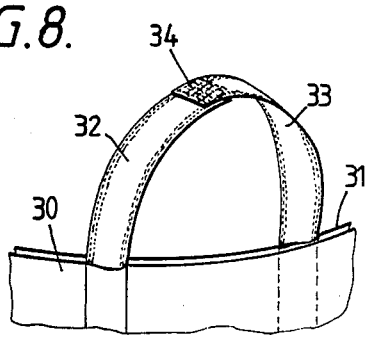

The foregoing description is of the preferred form of container, manufactured from a single length of tubular woven fabric. However, it will be understood that containers may be made in other ways. In one further example, partially illustrated in FIG. 8, two similar sections 30, 31 of tubular fabric may be used, each having been cut at one end to form upstanding reinforcing sections 32, 33. One such length of fabric is then simply drawn into the other length of fabric with a displacement of 45° between the two lengths, and the free end of each upstanding reinforcing section 32 of the resulting outer wall 30 is sewn to the free end of the adjacent upstanding reinforcing section 33 of the inner wall 31 as indicated at 34.

In other arrangements the inner and outer walls may be formed from suitable panels of fabric stitched together to give the required construction. In yet other embodiments, the lifting loops need not be integral extensions of reinforced sections of the wall fabric, but may be separate material, for example webbing such as used for car seat belts, stitched to the wall fabric, desirably in reinforced regions thereof.

The example described is of a container having four lifting loops, but it will be appreciated that the invention can be applied to a container having any even number of loops, and that when formed from a fabric having interwoven reinforcing bands those bands will be located according to the number of loops. Other modifications will be apparent to those skilled in the art.

We claim:

1. A flexible bulk container having a side wall structure and a plurality of lifting loops all formed from a single length of tubular woven fabric that comprises base fabric and reinforcing bands woven integrally with the base fabric and extending parallel to the axis of the tube, the tubular woven fabric having been folded transversely to the axis to form a tubular double-walled side wall structure having an outer wall and an inner wall of approximately equal lengths joined at the top of the container by lifting loops formed by lengths of the reinforcing bands, parts of the base fabric being cut away in the region of the lifting loops so that the lifting loops stand above the side wall structure, the lower end of the side wall structure being closed by a base.

2. A flexible bulk container according to claim 1 in which a first end of each lifting loop extends from a first region of the outer wall, a second end of each lifting loop extends from a second region of the inner wall, and the first and second regions are angularly spaced around the circumference of the container.

3. A flexible bulk container comprising a double-walled side wall structure having an outer wall and an inner wall lying within and closely adjacent to the outer wall, both said walls being approximately the same length, whereby to form such double-walled side wall structure, a separate base member connected to and closing a lower open end of the double walled side wall structure, and a plurality of lifting loops at the upper end of the side wall structure, each lifting loop having a first end that is connected to the outer wall and a second end that is connected to the inner wall.

4. Container of claim 3 wherein the first and second ends of each lifting loop are displaced one from the other around the circumference of the container.

5. Container of claim 3 wherein four lifting loops are provided, and the circumferential spacing between the two ends of each lifting loop is substantially equal to the circumferential spacing between adjacent lifting loops.

6. Container of claim 3 wherein the outer wall is formed from woven fabric comprising base fabric and reinforcing bands woven integrally with the base fabric, each reinforcing band extending from the lower to the upper end of the outer wall, and the first end of each lifting loop is connected to a respective one of the reinforcing bands.

7. Container of claim 3 wherein the inner wall is formed from woven fabric comprising base fabric and reinforcing bands woven integrally with the base fabric, each reinforcing band extending from the lower to the upper end of the inner wall, and the second end of each lifting loop is connected to a respective one of the reinforcing bands.

8. Container of claim 6 wherein the woven fabric from which such wall is formed is a tubular woven fabric, and the reinforcing bands extend parallel to the tubular axis thereof.

9. Container of claim 7 wherein the woven fabric from which such wall is formed is a tubular woven fabric, and the reinforcing bands extend parallel to the tubular axis thereof.

10. Container of claim 3 wherein the first end of each lifting loop is integral with the outer wall, and the second end of each lifting loop is integral with the inner wall.

11. Container of claim 10 wherein the outer wall and inner wall are each formed from woven fabric comprising base fabric and reinforcing bands woven integrally with the base fabric, each reinforcing band extending from the lower to the upper end of the corresponding wall, and the first end of each lifting loop is integrally connected to a respective one of the reinforcing bands of the outer wall, and the second end of each lifting loop is integrally connected to a respective one of the reinforcing bands of the inner wall.

12. Container of claim 11 wherein the woven fabric from which each such wall is formed is a tubular woven fabric, and the reinforcing bands extend parallel to the tubular axis thereof.

13. Container of claim 12 wherein each lifting loop comprises an integral extension of a reinforcing band of the outer wall and a reinforcing band of the inner wall.

14. Container of claim 13 wherein each lifting loop is continuous.

15. Container of claim 14 wherein the inner and outer walls and the lifting loops are all formed from a single continuous length of tubular woven fabric folded to form a double-walled tube, with parts of the base fabric being cut from the remainder of the base fabric in the folded region of the tube, and with such cut parts being folded around reinforcing band material to form the lifting loops.

16. Container of claim 15 wherein the tubular woven fabric has four reinforcing bands therein, substantially equally spaced around the fabric, the container has four lifting loops, and the inner wall is rotated through substantially 45 degrees relative to the outer wall.

* * * * *